US009248561B2

(12) United States Patent
Roscosky et al.

(10) Patent No.: US 9,248,561 B2
(45) Date of Patent: Feb. 2, 2016

(54) STUCK THREADED MEMBER EXTRACTOR TOOL AND EXTRACTION METHODS

(71) Applicants: James M. Roscosky, Irwin, PA (US); Shane M. Essay, Greenock, PA (US)

(72) Inventors: James M. Roscosky, Irwin, PA (US); Shane M. Essay, Greenock, PA (US)

(73) Assignee: U.S. Department of Energy, Washington, DC (US)

( * ) Notice: Subject to any disclaimer, the term of this patent is extended or adjusted under 35 U.S.C. 154(b) by 262 days.

(21) Appl. No.: 14/107,820

(22) Filed: Dec. 16, 2013

(65) Prior Publication Data

US 2014/0238202 A1 Aug. 28, 2014

Related U.S. Application Data

(60) Provisional application No. 61/768,811, filed on Feb. 25, 2013.

(51) Int. Cl.
*B25B 27/18* (2006.01)
*B25B 15/00* (2006.01)

(52) U.S. Cl.
CPC ..... *B25B 27/18* (2013.01); *B25B 15/005* (2013.01); *Y10T 29/49822* (2015.01)

(58) Field of Classification Search
CPC .. B25B 27/18; B25B 15/005; Y10T 29/49822
USPC ..... 81/53.2, 441
See application file for complete search history.

(56) References Cited

U.S. PATENT DOCUMENTS

| | | | | |
|---|---|---|---|---|
| 1,863,046 | A | 6/1932 | Githens et al. | |
| 1,875,484 | A * | 9/1932 | Nigra | B25B 27/18 81/441 |
| 2,062,383 | A | 12/1936 | West | |
| 4,503,737 | A | 3/1985 | DiGiovanni | |
| 5,251,516 | A | 10/1993 | Desailiners | |
| 6,761,089 | B2 | 7/2004 | Bergamo | |
| 7,152,509 | B2 | 12/2006 | McCalley, Jr. et al. | |
| 8,448,547 | B2 * | 5/2013 | Whitehead | B25B 15/005 81/441 |
| 8,899,254 | B1 * | 12/2014 | Weiler | F16L 55/1108 81/53.2 |
| 8,955,415 | B2 * | 2/2015 | Lin | B25B 27/18 81/441 |

* cited by examiner

*Primary Examiner* — Hadi Shakeri
(74) *Attorney, Agent, or Firm* — Robert T. Burns; John T. Lucas

(57) ABSTRACT

Disclosed is a tool having a tapered first portion configured to translate a rotational force to the stuck member, a second portion connecting with the first portion and configured to translate the rotational force to the tapered first portion, a planar tip at an end of the first portion and perpendicular to a central axis passing through the first portion and the second portion, a plurality of left-handed splines extending helically around the central axis from the tip toward the second portion, a driver engaged with the second portion and configured to receive a third rotational force from a mechanical manipulator, and a leak seal connected to the driver and configured to form a seal around the stuck member and at least a portion of the driver and prevent gases opposite the stuck member from escaping.

9 Claims, 2 Drawing Sheets

STUCK THREADED MEMBER EXTRACTOR TOOL AND EXTRACTION METHODS

NOTICE OF GOVERNMENT RIGHTS

The United States Government has rights in this application and any resultant patents claiming priority to this application pursuant to contract DE-AC11-98PN38206 between the United States Department of Energy and Bechtel Marine Propulsion Corporation Knolls Atomic Power Laboratory.

TECHNOLOGICAL FIELD

The present subject matter relates generally to extractor tools and extraction methods.

BACKGROUND

At times threaded members or fasteners (hereinafter referred to as a member or threaded member) become stuck in a work piece or other object. The socket of the member may become rounded or otherwise damaged, for example, such that a standard tool used to tighten and loosen the member can no longer apply enough force to move it. Typical extraction tools and extraction methods to extract a stuck threaded member includes drilling a hole through the centerline of the member and then engaging a tip of the extraction tool in the drilled hole to allow the extraction tool to penetrate and apply force to the stuck member. A typical extraction tool includes multiple left-handed helical splines with long leads to allow generous penetration into the stuck member along the drilled hole. The extraction tool is tapered to help align the tool with the drilled hole. Left-handed splines are used so that when the extraction tool turns counter-clockwise to tighten the tool (to penetrate the tool further into the member, for example) a loosening torque is exerted on the stuck member.

Drilling a hole into the member is not always practical or preferable, however. In the nuclear industry, for example, some containers store highly radioactive material. Due to the radioactivity, handling and operating of these containers is performed remotely using mechanical manipulators located within a shielded hot cell holding the containers. The mechanical manipulators are controlled by operators outside the shielded hot cell. In such operations, a leak seal is often used in conjunction with the extraction tool to prevent radioactive gases from escaping the container. The remote nature of these operations, especially when using a leak seal, makes drilling a hole in the stuck member difficult.

Moreover, existing tools are unable to obtain sufficient penetration for adequately gripping a stuck plug, and require a striking force necessary to "start" extracting a stuck member. Existing tool splines are also easily damaged or sheared during installation or loosening torque application and lack sufficient "grip" within the limited engagement length available to transmit required loosening torque. In view of the foregoing, a need exists for a novel extraction tool and method of extracting a stuck member.

BRIEF SUMMARY

Exemplary embodiments of the present subject matter include stuck threaded member extractor tools and extraction methods. In certain embodiments, a tool is configured to engage the stuck member by cutting or digging into the stuck member without a pre-existing hole. According to one embodiment, a tool for extracting a stuck member has a tapered first portion configured to translate a first rotational force to the stuck member. A second portion connects with the first portion and is configured to translate a second rotational force to the tapered first portion. The end of the first portion has a planar tip perpendicular to a central axis passing through the first portion and the second portion. A plurality of left-handed splines extends laterally along the central axis from the tip toward the second portion, and a driver engages with the second portion and is configured to receive a third rotational force from a mechanical manipulator. In certain exemplary embodiments, a leak seal connects to the driver and is configured to form a seal around the stuck member and at least a portion of the driver and prevent gases opposite the stuck member from escaping through an opening created by extraction of the stuck member.

In other exemplary embodiments, the first portion extends lengthwise along the central axis from the planar tip toward the second portion, with a diameter of the tapered first portion increasing from the planar tip toward the second portion. The second portion extends lengthwise along the central axis from a second end toward the first portion, and the second portion is configured to mate with a socket of the driver. In still further exemplary embodiments, the plurality of splines define a thread angle no greater than 60°, and the plurality of splines form edges that are configured to cut into the stuck member. In other exemplary embodiments, there are at least five left-handed splines. In still further embodiments, the first portion has a hardness in a range of 56 to 58 Rockwell C scale.

In an exemplary method of extracting a stuck member, the method includes the step of contacting a tapered first portion with a stuck member. In this exemplary method, the tapered first portion is configured to translate a first rotational force to the stuck member, with the tapered first portion having a planar tip at an end of the first portion and being perpendicular to a central axis passing through the first portion. In certain exemplary methods, the planar tip has a plurality of left-handed splines extending laterally along the central axis from the tip toward a second portion. The method further includes the steps of connecting the second portion with the first portion such that the central axis passes through the second portion, and configuring the second portion to translate a second rotational force to the tapered first portion. The exemplary method further includes the steps of engaging a driver with the second portion, and configuring the driver to receive a third rotational force from a mechanical manipulator. The exemplary method further includes the steps of forming a seal around the stuck member and at least a portion of the driver such that the seal prevents gases opposite the stuck member from escaping through an opening created by extraction of the stuck member, and rotating the tapered first portion into the stuck member such that the tapered first portion cuts into the member and the plurality of splines grips the stuck member and translates a portion of at least one of the first, second, and third rotational forces to the stuck member.

DETAILED DESCRIPTION

Figure 1:
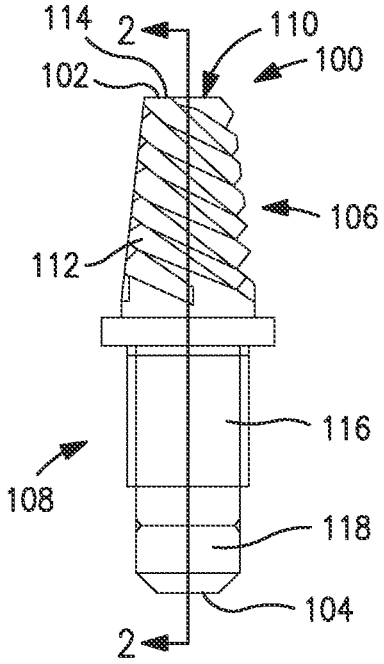
FIG. 1 illustrates a side view of a tool according to an exemplary embodiment of the present subject matter.
Figure 2:
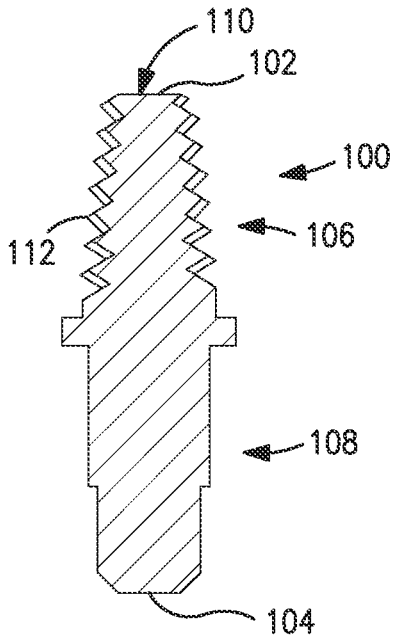
FIG. 2 is a cross-sectional view of the exemplary embodiment of FIG. 1.
Figure 3:
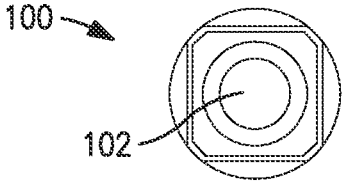
FIG. 3 illustrates a rear view of the exemplary embodiment of FIG. 1.
Figure 4:
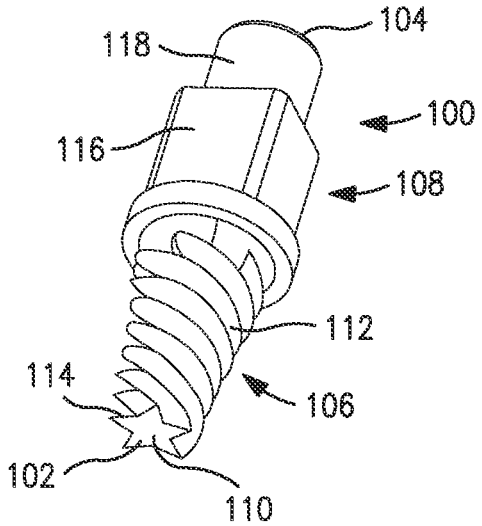
FIG. 4 illustrates a perspective view of the exemplary embodiment of FIG. 1.

Exemplary embodiments of the present subject matter are described below, with reference to the accompanying drawings. Certain exemplary embodiments of the present subject matter include stuck threaded member extractor tools and extraction methods. In certain embodiments, the tool is configured to engage the stuck member by cutting or digging into the stuck member without a pre-existing hole. Throughout the specification, like reference numerals refer to like elements. The present subject matter may be embodied in many different forms and should not be construed as being limited to the embodiments set forth herein.

As illustrated in FIGS. 1 through 4, a tool 100 extends lengthwise along a central axis (Z) from a first end 102 to a second end 104, and widthwise in a direction perpendicular to the central axis. The tool 100 includes a first portion 106 and a second portion 108. The first portion 106 extends from the first end 102 toward the second portion 108, and the second portion 108 extends from the second end 104 toward the first portion 106. The first portion 106 defines a tip 110 of the tool at the first end 102 and a plurality of splines 112 extending helically around the central axis from the tip 110 toward the second portion 108. In the embodiment shown in FIGS. 1-4, the tip 110 is generally perpendicular and planar to the central axis (Z). The tip 110 and the splines 112 form edges 114. Due to the general perpendicular arrangement between the tip 110 and the splines 112, the edges 114 are sharp. Also, according to the illustrated embodiment, the tip 110 forms a star shape due to the five splines 112. The edges 114 are configured to facilitate the digging or cutting into the stuck member by the tool 110 as it rotates into the stuck member without having to strike the stuck member to initiate engagement.

In the illustrated embodiment, the first portion 106 defines five splines 112. The first portion 106 is tapered, having a first portion diameter which increases from the tip 110 toward the second portion 108. Specifically, the first portion 106 defines a taper angle (i.e., the rate of change in the diameter of the first portion along the central axis defined by the splines). As an example and according to the illustrated embodiment, the first portion 106 defines a taper angle of 7°. A relatively small taper angle (compared to typical and conventional extractor tools), such as 7°, permits a relatively large spline area to contact the stuck member compared to conventional extractor tools and the increase contact area between the tool 100 and the stuck member allows for more friction and force to be exerted between the tool and the stuck member. The splines 112 define a thread angle, i.e., the angle between adjacent splines.

In general, the smaller the thread angle, the higher the number of splines along a unit of length. In the illustrated embodiment, the thread angle is 60°. These angles and number of splines are exemplary only, as is their orientation. Other angles, numbers of splines, and spline orientations can be used without departing from the scope of the disclosed subject matter. In other exemplary embodiments, the thread angle may be less than 60°. In the exemplary embodiment shown, the relatively small thread angle (compared to typical and conventional extractor tools), such as 60°, facilitates the tool 100 digging or cutting into a stuck member (not shown in FIGS. 1-4). The direction of the splines 112 may be left-handed or right-handed. According to the exemplary embodiment illustrated in FIGS. 1-4, the splines 112 are left-handed. The left-handed splines 112 are used so that as the tool 100 rotates counter-clockwise, the splines 112 dig or cut into the stuck member. With stuck members having right-handed threads, counter-clockwise rotation helps loosen the stuck member.

In general, the above geometry regarding the plurality of splines 112 and the relatively small and swallow angles is to increase the density of splines 112 per unit of length and thus increase the grip between the tool 100 and the stuck member per unit of length. However, such a geometry tends to decrease the cross-section of each spline 112. In order to increase the strength of each spline 112, despite a decreased cross-section, a strong material may be used to form the tool 100 and the splines 112. The material has sufficient hardness to engage the stuck member and sufficient toughness to sustain the stresses imposed on the tool 100 during extraction of the stuck member. As an example, it has been found that S7 tool steel, heat treated to obtain a hardness of 56-58 Rockwell C scale is a suitable material. Other materials may be used as well. For example, other materials that can withstand 200 in-lb torque may be used without departing from the scope of the disclosed subject matter.

Figure 5:
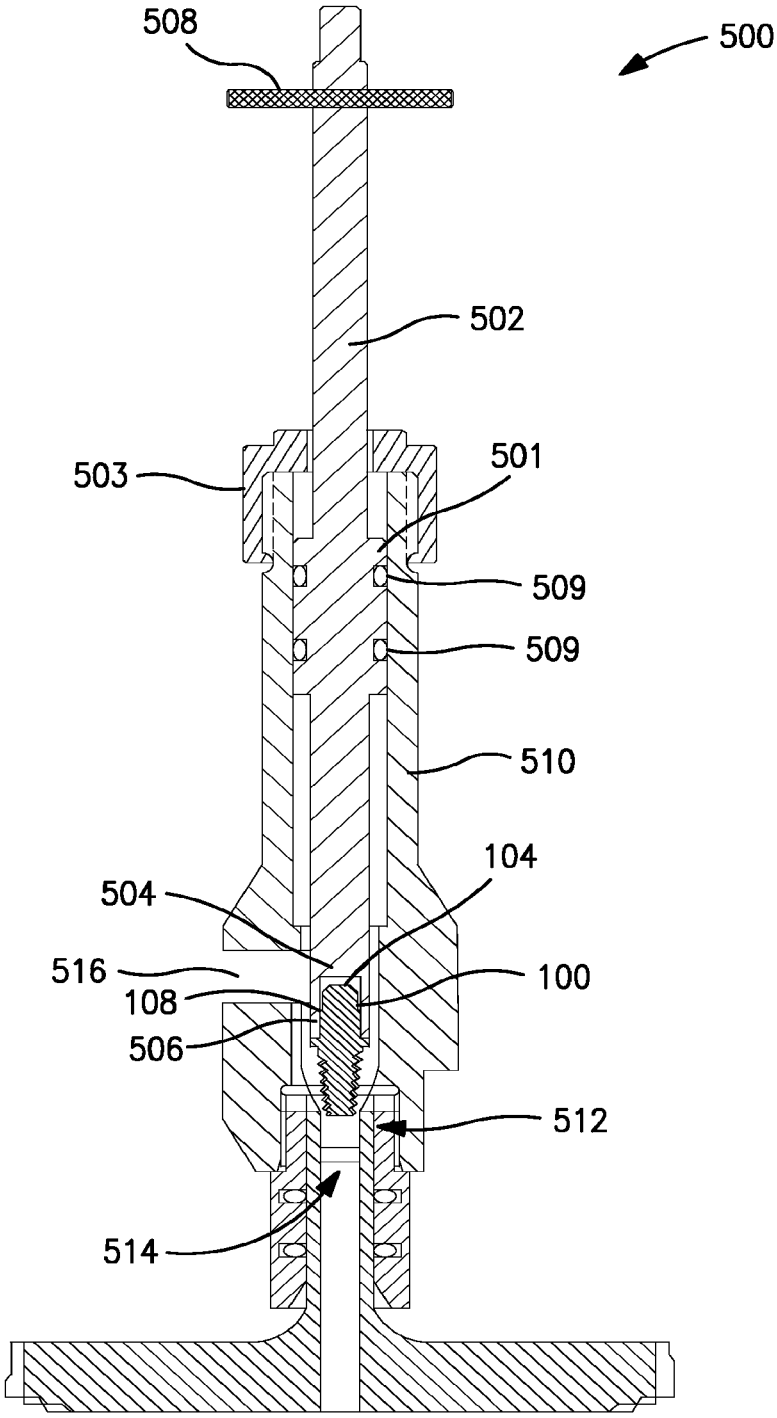
FIG. 5 illustrates a cross-sectional view of an exemplary embodiment of a tool assembly that includes the tool of FIGS. 1-4.

As shown in the exemplary embodiment of FIG. 5, the second portion 108 of the tool may be configured to engage a wrench, adapter, or other driver 502 of a tool assembly 500 configured to translate a rotational force. As an example and according to the illustrated embodiment, the second portion 108 defines a first area 116 having a square-shaped cross-section (with chamfered corners) to aid insertion into a driver component 502 and a second area 118 having a circular-shaped cross-section. The driver component 502 optionally includes a first end 504 that defines a squared-shaped socket 506 configured to engage the second portion 108 of the tool assembly 500. A second end 508 of the driver 502 may be configured to engage a mechanical manipulator (not shown). The mechanical manipulator may be used to rotate the driver 502. The rotation of the driver 502 applies a rotation force onto the tool assembly 500 through the engagement of the socket 506 of the driver 502 and the second end 104 of the tool 100.

In the exemplary embodiment of FIG. 5, tip 110 is configured to interface with and form a part of tool assembly 500. Tip 110 connects with second portion 108, which interfaces with driver component 502, which extends outside the main body of tool assembly 500 through a threaded cap 503 and ends in second end 508. Driver 502 is configured to be moveable back and forth, limited by a lip 501. Second end 508 connects with driver 502 via an interference fit. Other fastening mechanisms in addition to and/or in place of threading and/or interference fitting can be used without departing from the scope of the present subject matter.

In addition to the driver component 502 and the tool 100, the tool assembly 500 of FIG. 5 may include a leak seal 510. In embodiments with a leak seal 510, the internal volume of tool assembly 500 is sealed from the outside environment. The embodiment shown uses one or more o-rings 509 to form a seal, but other sealing mechanisms may be use in place of or in addition to o-rings 509 without departing from the scope of the present subject matter. The leak seal 510 is configured to prevent gases located opposite the stuck member 512 from escaping through an opening 514 created by extraction of the stuck member 512. In instances when the member is stuck in a wall of a container storing radioactive materials, the leak seal 510 is configured to prevent radioactive gas from escaping from the container once the stuck member is removed. In the exemplary embodiment of FIG. 5, the leak seal 510 is configured to form a seal around the member 512, and at least a portion of tool 100 and/or at least a portion of driver 502. In this exemplary embodiment, a gas capture port 516 connects with and forms a gas-tight seal with leak seal 510 and is configured to transfer any escaping gases to a gas collection container (not shown).

With the configuration of the exemplary embodiment of FIG. 5, the tool assembly 500 extracts a stuck member without needing a hole drilled into the stuck member 512 prior to the introduction of the tool 100. In certain exemplary embodiments, a method of extracting a stuck member 512 includes arranging the tool assembly 500 against a stuck member 512 such that the tip 110 of the tool 100 is in contact with a solid surface (i.e., no pre-existing hole at the point of contact) of the stuck member 512, and rotating the tool into the stuck member 512 such that the tool 100 cuts into the stuck member 512 and a plurality of splines 112 of the tool grip the stuck member 512 and translate a loosening rotational force to the stuck member 512.

Many modifications and other embodiments of the present subject matter set forth herein will come to mind to one skilled in the art having the benefit of the teachings presented in the foregoing descriptions and the associated drawings. Therefore, it is to be understood that the present subject matter is not to be limited to the specific embodiments disclosed and that modifications and other embodiments are intended to be included within the scope of the appended claims. Although specific terms are employed herein, they are used in a generic and descriptive sense only and not for purposes of limitation.

What is claimed is:

1. A tool for extracting a stuck member, comprising:

a tapered first portion configured to translate a rotational force to the stuck member;

a second portion connecting with the first portion and configured to translate the rotational force to the first portion;

a planar tip at a tapered end of the first portion and perpendicular to a central axis passing through the first portion and the second portion;

a plurality of left-handed splines extending helically around the central axis from the tip toward the second portion;

a driver engaged with the second portion and configured to receive the rotational force from a mechanical manipulator;

a leak seal connected to the driver and configured to form a seal around the stuck member and at least a portion of the driver and prevent gases opposite the stuck member from escaping through an opening created by extraction of the stuck member; and a gas capture port connecting with the leak seal.

2. The tool of claim 1, wherein:

the first portion extends lengthwise along the central axis from the planar tip toward the second portion;

a diameter of the tapered first portion increases from the planar tip toward the second portion;

the second portion extends lengthwise along the central axis from a second end toward the first portion; and the second portion is configured to mate with a socket of the driver.

3. The tool of claim 2, wherein:

the plurality of splines define a thread angle no greater than 60°; and the plurality of splines form edges configured to cut into the stuck member.

4. The tool according to claim 3, wherein there are at least five left-handed splines.

5. The tool according to claim 4, wherein the first portion defines a taper angle of 7°.

6. The tool according to claim 2, wherein the first portion has a hardness in a range of 56 to 58 Rockwell C scale.

7. The tool according to claim 2, wherein:

the plurality of splines define a thread angle no greater than 60°;

the plurality of splines form edges configured to cut into the stuck member;

there are at least five left-handed splines; and the first portion has a hardness in a range of 56 to 58 Rockwell C scale.

8. The tool according to claim 7, wherein the first portion defines a taper angle of 7°.

9. A method of extracting a stuck member, comprising the steps of:

contacting a tapered first portion with a stuck member, wherein:

the first portion is configured to translate a rotational force to the stuck member, the first portion has a planar tip at a tapered end of the first portion and perpendicular to a central axis passing through the first portion, the planar tip has a plurality of left-handed splines extending helically around the central axis from the tip toward a second portion, the second portion is configured to translate the rotational force to the first portion, and a driver is configured to engage with the second portion and receive the rotational force from a mechanical manipulator;

forming a leak seal around the stuck member and at least a portion of the driver such that the leak seal prevents gases opposite the stuck member from escaping through an opening created by extraction of the stuck member;

rotating the first portion into the stuck member such that the first portion cuts into the member and the plurality of splines grips the stuck member and translates at least a portion of the rotational force to the stuck member; and capturing escaped gas via a gas capture port connecting with the leak seal.

* * * * *